US005937875A

United States Patent [19]

Nygren

[11] Patent Number: 5,937,875

[45] Date of Patent: Aug. 17, 1999

[54] APPARATUS AND METHOD FOR CLEANING SPRAYERS

[76] Inventor: Richard Nygren, 309 S. Harvard, Arlington Heights, Ill. 60005

[21] Appl. No.: 08/723,111

[22] Filed: Sep. 30, 1996

[51] Int. Cl.[6] ..... B08B 3/02

[52] U.S. Cl. ..... 134/22.11; 134/25.4; 134/166 C; 134/169 C; 134/170; 134/200

[58] Field of Search ..... 134/166 C, 169 C, 134/166 R, 169 R, 170, 200, 135, 22.1, 22.11, 25.4; 42/70.04, 70.06; 89/136

[56] References Cited

U.S. PATENT DOCUMENTS

| | | | |
|---|---|---|---|
| 1,145,607 | 7/1915 | Morris | 134/200 |
| 1,642,461 | 4/1927 | Barker | 134/200 |
| 2,168,770 | 8/1939 | Gunn, Jr. | 134/200 |
| 2,512,140 | 6/1950 | Childs et al. . | |
| 2,641,270 | 6/1953 | Allen | 134/200 |
| 2,670,000 | 2/1954 | Amer | 134/200 |
| 2,682,273 | 6/1954 | Roach . | |
| 2,745,418 | 5/1956 | Balcom et al. . | |
| 2,786,000 | 3/1957 | Roach . | |
| 2,948,978 | 8/1960 | Salverda . | |
| 3,707,404 | 12/1972 | Carlson . | |
| 3,771,539 | 11/1973 | DeSantis . | |
| 3,890,988 | 6/1975 | Lee . | |
| 3,904,431 | 9/1975 | Dinerman . | |
| 4,025,363 | 5/1977 | DeSantis . | |
| 4,133,340 | 1/1979 | Ballard . | |
| 4,236,552 | 12/1980 | Rayboy . | |
| 4,785,836 | 11/1988 | Yamamoto . | |
| 4,793,369 | 12/1988 | Robb et al. . | |
| 4,827,955 | 5/1989 | Stern . | |
| 4,899,769 | 2/1990 | Tsai | 134/200 |
| 4,923,522 | 5/1990 | Sowers . | |
| 5,174,317 | 12/1992 | Robb et al. . | |
| 5,193,561 | 3/1993 | Robb et al. . | |
| 5,220,933 | 6/1993 | Albers | 134/170 |
| 5,388,601 | 2/1995 | Mansur | 134/169 C |
| 5,485,860 | 1/1996 | Robb et al. . | |
| 5,487,418 | 1/1996 | Reyes . | |
| 5,628,971 | 5/1997 | Norman . | |

*Primary Examiner*—Frankie L. Stinson
*Attorney, Agent, or Firm*—Juettner Pyle Piontek & Underwood

[57] ABSTRACT

An apparatus for cleaning a sprayer, the sprayer having a material inlet, comprising a housing, a rack within the housing for supporting the sprayer, an adapter having one end adapted to connect to the material inlet of the sprayer, a tube within the housing having one end connected to the other end of the adapter, a solvent supply, and means for circulating solvent connecting the solvent supply to the tube, for circulating solvent from said solvent supply, through the tube and the adapter, and into the sprayer. The apparatus includes a sprayer trigger holder, comprising a unitary, resilient, spring wire clip, having at one end a C-shaped portion for holding the trigger in a retracted position, and the other end of the wire clip having a hook-shaped portion for hanging the sprayer. The housing comprises two housing members hinged together, one member having a seating edge and an adjacent outwardly projecting bead, the other member has an inner rim and an adjacent inwardly projecting shoulder, the edge seating on the shoulder forming a primary seal for the housing, and the projecting bead engaging the inner rim forming a secondary seal.

20 Claims, 4 Drawing Sheets

APPARATUS AND METHOD FOR CLEANING SPRAYERS

SUMMARY OF THE INVENTION

In normal usage, the exterior and interiors of sprayers, such as paint spray guns, become covered with paint or other spray materials, which materials need to be removed before the material dries or cures. My invention provides a facile solution.

The apparatus of my invention comprises a housing, a rack within the housing for supporting a sprayer, an adapter connected to a material inlet of the sprayer, a flexible tube within the housing connected to the adapter, an external spray system, a solvent supply, and a solvent circulation system by which solvent is circulated through the tube, adapter, and into the sprayer, and through the external spray system.

A second feature of my invention is clip for holding the sprayer trigger in a retracted position. The clip is a unitary, resilient, spring wire. At one end of the clip is a C-shaped portion. A front end of the C-shaped portion engages the trigger of the sprayer and the back end of the clip engages a sprayer body or handle. The C-shaped portion thereby holds the spray gun trigger in a retracted position. The other end of the wire clip has a hook-shaped portion for hanging the wire clip and the spray gun held therewith from the rack within the housing.

A further feature of my invention is a gasketless housing seal. The housing comprises two mating housing members hinged together like a clam shell. The top housing member has a seating edge and an outwardly projecting bead above the seating edge. The bottom housing member has an inner rim and an inwardly projecting shoulder below the inner rim. When the two halves are bought together the seating edge seats on the shoulder forming a primary seal. Also, the projecting bead engages the inner rim forming a secondary seal, and a guide to ensure the shape of the primary edge seal.

The method of my invention comprises providing a wash and a rinse solvent supplies connected to the solvent circulating system. A clip is attached to a spray gun to retract and hold the trigger. An adapter is connected to the material inlet to the spray gun. The other end of the adapter is connected to a tube within the housing. The clip may be used to hang the sprayer from a rack within a housing. The housing is then closed. By turning a valve the wash solvent supply is connected to the circulating system which circulates solvent from the wash solvent supply, through the tube, adapter, spray gun and back into the wash solvent container. Afterwards the first valve is close and a second valve opened. The second valve connects the rinse solvent supply to the circulating system, which circulates clean solvent through the tube, adapter, sprayer and into the wash solvent supply container for reuse.

DETAILED DESCRIPTION

Figure 1:
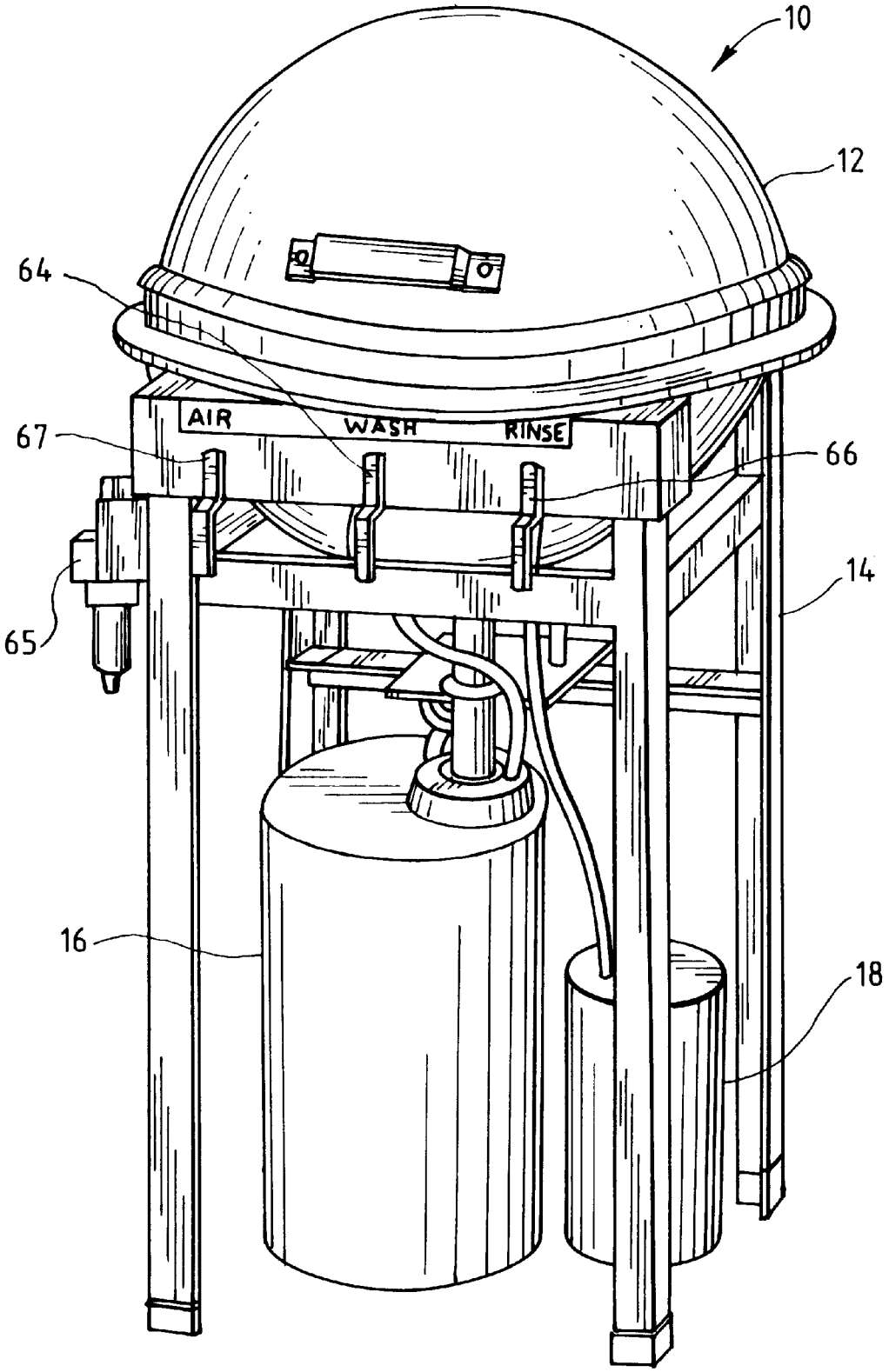
FIG. 1 is a perspective view of the apparatus of my invention.
Figure 2:
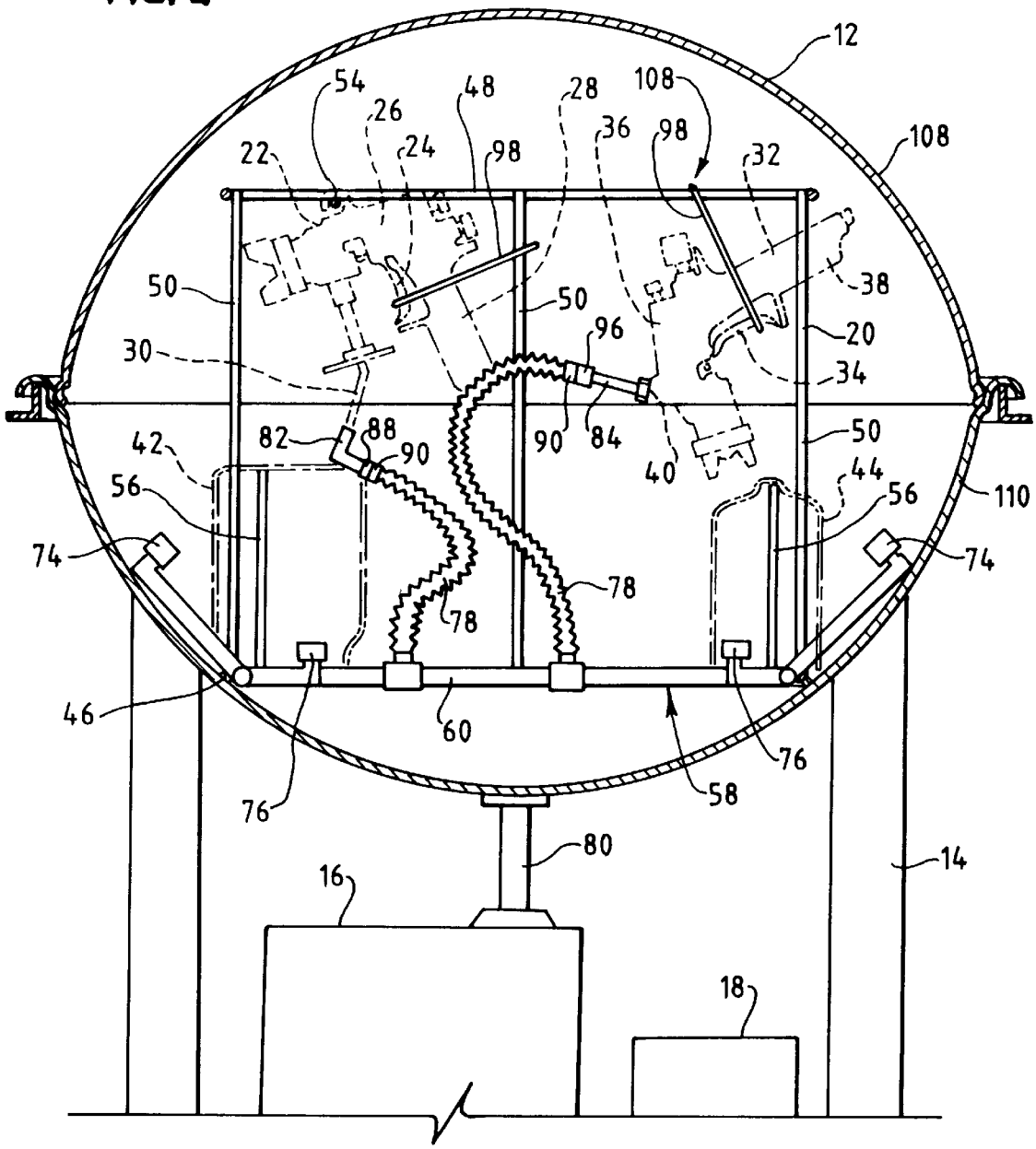
FIG. 2 is a vertical cross section of the housing interior of my invention.
Figure 3:
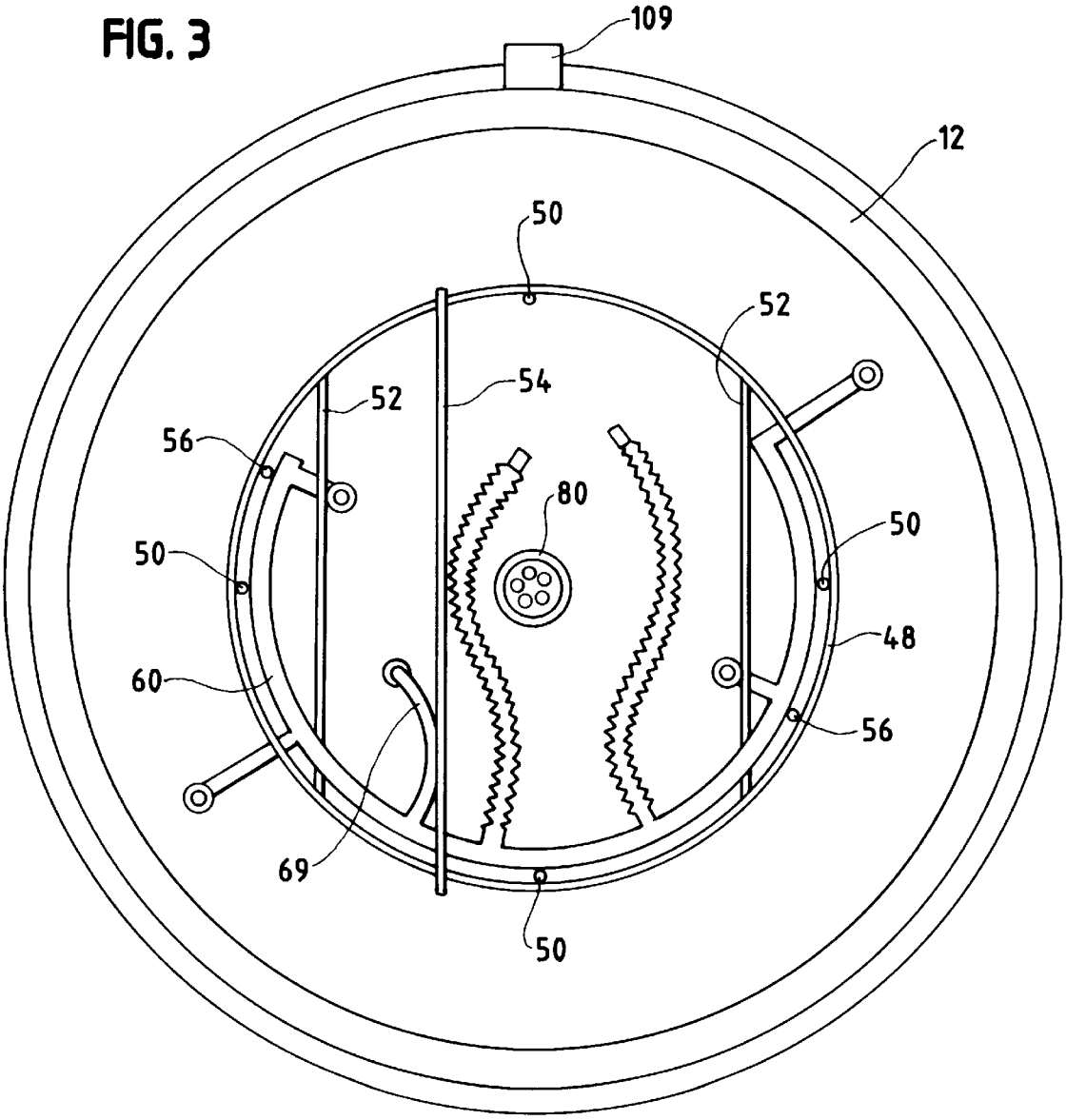
FIG. 3 is an interior top plan view of the housing interior of my invention.

FIGS. 1–3 of the drawings illustrate the sprayer cleaning apparatus 10 of my invention. FIG. 1 is an exterior view of a housing 12, a frame 14 for supporting the housing, a primary or wash solvent container 16 and a secondary or rinse solvent container 18. FIGS. 2 and 3 show the interior of the housing 12.

A removable rack 20 is mounted within housing 12. The rack functions to support one or more sprayers, such as paint spray guns 22 and 32. The spray guns have triggers 24 and 34, bodies 26 and 36, and handles 28 and 38. Spray gun 22 is of the suction type and has a material inlet tube 30. Spray gun 32 is of the gravity type and has a threaded material inlet 40. Also shown are paint cups 42 and 44.

The rack 20 is fabricated from stainless steel rod and comprises a lower ring 46, an upper ring 48, and three or more vertical members 50 welded to ring members 46 and 48. Optionally, the rack may include horizontal members 52 welded to lower ring member 46 and a moveable bar 54 which hooks onto the top of ring member 48. The rack preferably includes posts 56, welded to lower ring 46, for supporting paint cups 42 and 46.

Figure 4:
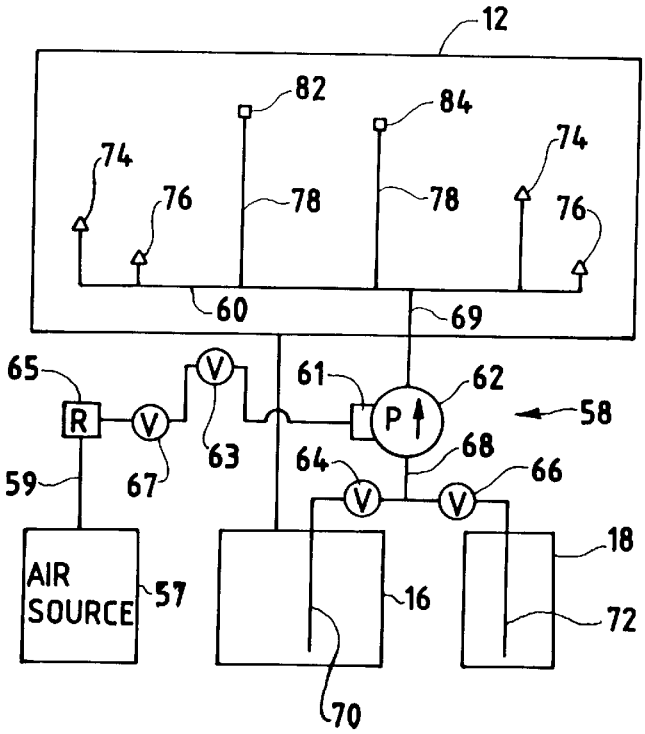
FIG. 4 is a plumbing schematic of the solvent supply system of my invention.

FIGS. 2–4 illustrate a solvent circulating system 58. The solvent circulating system comprises a manifold 60, pump 62, valves 64 and 66, solvent lines 68, 69, 70 and 72. The circulating system is assembled from standard, commercially available hardware. Manifold 60 and solvent lines 68, 69, 70 and 72 are preferably assembled from solvent resistant plastic tubing. Pump 62 is preferably a compressed air powered diaphragm pump. Valves 64 and 66 are off-the-shelf plumbing valves. The circulating system 58 conveys solvent from solvent supply containers 16 or 18 to spray nozzles 74 and 76, and flexible tubes 78. Nozzles 74 and 76 are common brass spray nozzles. Tubes 78 preferably are flexible Teflon tubes having accordion pleats so they may be easily manipulating when attaching or detaching spray guns. Tubes 78 are connected to spray guns 22 and 32 by means of adapters 82 and 84. Solvent in housing 12 is returned to the primary solvent supply container through drain line 80.

The pump 62 is powered by a compressed air motor 61. Compressed air from a shop source 57 is first routed to a regulator 65. Line 59 then runs to an air valve 67, and from there to a safety shut-off valve 63 located at the housing hinge 109. The safety valve 63 is configured to interrupt the supply of compressed air to the pump motor whenever the housing is open. The air line 59 extends from the safety valve 63 to the pump motor. The motor is activated by closing the housing and opening the air valve 67.

Figure 5:
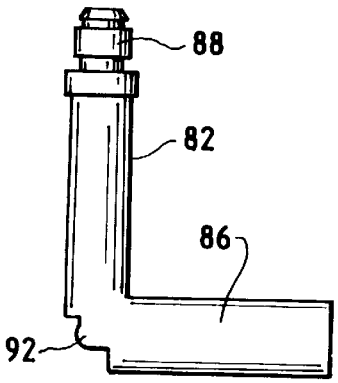
FIG. 5 is a detailed elevational view of one adapter of my invention.

FIG. 5 shows adapter 82 in detail. The adapter comprises a first end 86 adapted to fit the material inlet tube 30 of a suction type paint spray gun. The first end 86 is made from a resilient plastic material so it may be press fit over an inlet tube. The other end 88 of the adapter connects to a tube 78. The connection preferably includes a quick disconnect fitting. The male portion 88 of the quick disconnect fitting is carried by adapter 82 and the female portion is carried by the free end of tube 78. The connections of the adapter to both the spray gun and the circulating system are positive connections, i.e., secure, not loose, and substantially leak free. Adapter 82 may be bent at 92, or may be straight.

Figure 6:
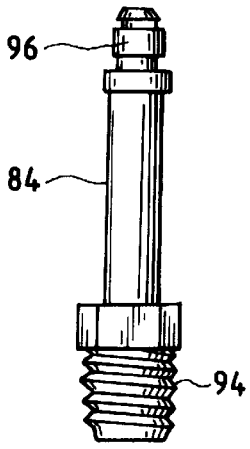
FIG. 6 is a detailed elevational view of a second adapter of my invention.

FIG. 6 illustrates an adapter suitable for use with a gravity type paint spray gun 36. A gravity gun typically is provided with a threaded material inlet 40 which may be either male or female. Accordingly, adapter 84 is provided with a first end 94 having a threaded portion to mate with a threaded material inlet. The threaded portion is preferably plastic so it cannot damage the metal threads of the spray gun. The other end 96 of adapter 84 is also provided with the male half of a quick disconnect fitting.

Figure 7:
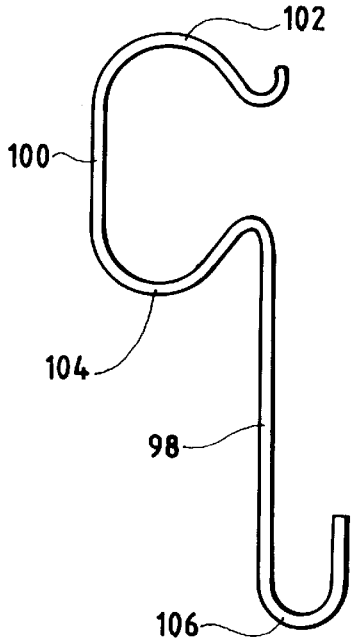
FIG. 7 is a detailed elevational view of a spray gun trigger clip of my invention.

Many sprayers, especially paint spray guns, have triggers 24 and 34 for activating the sprayer. To properly clean the internal passages of the sprayer, it is necessary to retract the trigger. I have invented a unique clip 98 to retract and hold the trigger. The clip 98 is shown in detail in FIG. 7. The clip includes a C-shaped portion 100. A front end 102 of the C-shaped portion is adapted to engage the trigger, and the back end 104 of the C-shaped portion is adapted to engage either the handle 28, 38 or body 26, 36 of a spray gun. The other end of the clip 98 preferably includes a hook-shaped portion 106. The hook portion may be used to hang the clip and spray gun from the rack 20, as shown at 108 in FIG. 2. The clip is fabricated from a unitary piece of stiff, resilient, metal, wire, preferably stainless steel.

Figure 8:
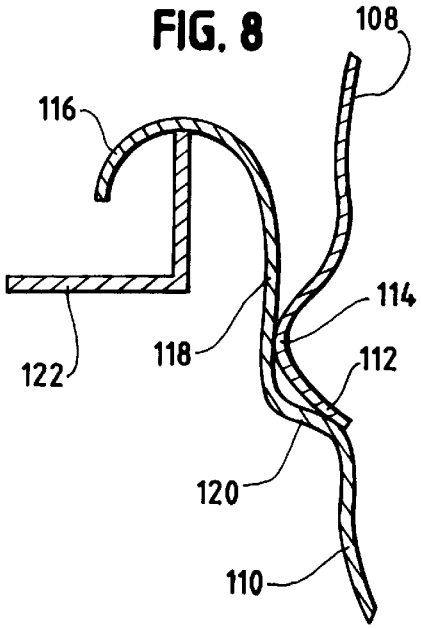
FIG. 8 is a detailed cross-sectional view of the gasketless housing seal of my invention.

The housing 12 comprises two semi spherical portions, an upper portion 108 and a lower portion 110 hinged together at 109. The housing may be fabricated from sheet aluminum or other metal by spinning or by deep draw. To prevent the escape of solvents, it is necessary to seal the two housing portions. For this purpose, I have invented a gasketless seal, which is shown in detail in FIG. 8. The upper housing portion 108 has a sealing edge 112 and an adjacent outwardly projecting bead 114 that run circumferentially around the lower end of the upper portion. The lower housing portion 110 has a lip 116, inner rim 118 and shoulder 120. When the two housing portions are brought together, the edge 112 seats on shoulder 120 forming a primary seal. Also, bead 114 engages inner rim 118, which acts to guide the edge onto the shoulder and forms a secondary seal. The lip 116 receives a circumferential angle iron 122 which is connected to the frame 14 for supporting the housing.

The method of my invention operates as follows. Solvent is added to the primary and rinse solvent supplies. A clip 98 is attached to a spray gun to retract and hold the trigger. An adapter 82 or 84 is selected based on the type of material inlet to the spray gun. The first end of the adapter is connected to the spray gun material inlet. The other end of the adapter is connected to one of the tubes 78 emanating from the manifold 60. The connection is quickly made with the quick disconnect fittings. The spray gun is then hung from rack 20 either by a hook on the gun body or by hook portion 106 of clip 98.

If desired a second gun may be prepared for cleaning in similar fashion by attaching a clip and adapter. If only one gun requires cleaning, a plug may be inserted in the free end of the unused tube 78 to maintain pressure in the solvent circulating system. Alternatively, a quick disconnect fitting with automatic fluid shut-off may be used, in which event a plug would not be needed.

The housing is closed, whereby a gasketless, dual seal is formed between the upper and lower housing portions. The valve 66 is closed to cut off the rinse solvent supply. Valve 64 is opened to connect the circulating system with the primary or wash solvent container. Air valve 67 is opened activating pump 62 causing solvent to flow from the primary container 16 through lines 70 and 68 to manifold 60. From manifold 60 the solvent is distributed to nozzles 74 and 76 and tubes 78. From tubes 78, the solvent flows through the adapters 82 and 84 into the spray guns. Because the triggers have been retracted, the solvent flows through the gun cleaning it of spray material. The solvent and removed spray material is sprayed from the gun nozzle in normal fashion and contained within the sealed housing 12. Meanwhile, solvent being sprayed from nozzles 74 and 76 cleans the interior of the paint spray gun cups and the exterior surfaces of the spray guns and cups. The solvent and removed spray material exits the housing through drain line 80, returning the solvent and removed spray material to the primary solvent container 16.

After the wash cycle has been run for a sufficient time, typically one to five minutes, the wash valve 64 may be closed. The rinse valve 66 is then opened for approximately ten to fifteen seconds. In the rinse cycle, fresh solvent from rinse container 18 is drawn through lines 66 and 68, pump 62, manifold 60, tubes 78 and nozzles 74 and 76 to rinse the entire circulating system. The clean solvent then passes through the internal passages of the spray gun and is sprayed from nozzles 74 and 76 to rinse the interior and exteriors of the spray guns and cups. The rinse solvent then exists through drain 80 and into the primary solvent container 16. The solvent in rinse container 18 remains pure.

While my preferred embodiment has been shown and described, it is to be understood that various modifications and changes could be made thereto without departing from the scope of the invention as defined by the appended claims.

I claim:

1. An apparatus for cleaning a sprayer with solvent from a solvent supply, the sprayer having a material inlet, comprising:

a housing;

a rack within said housing for supporting the sprayer;

an adapter having a first and a second end, the first end adapted to removably connect to the material inlet of the sprayer, the second end having one portion of a quick disconnect fluid connector, said adapter being removable from said housing;

a flexible tube within said housing, said tube having at one end the other portion of said quick disconnect fluid connector for quickly connecting and disconnecting said tube to and from said adapter; and means for circulating solvent connected to said tube, for circulating solvent from the solvent supply, through said tube and said adapter, and into the sprayer.

2. A cleaning apparatus as in claim 1 wherein said tube has accordion pleats.

3. A cleaning apparatus as in claim 1, wherein said first end of said adapter has a screw thread adapted to mate with a threaded material inlet to the sprayer.

4. A cleaning apparatus as in claim 1, said sprayer having a material inlet tube, wherein said first end of said adapter comprises a tube adapted to be press fit onto the inlet tube of the sprayer.

5. A cleaning apparatus as in claim 1, wherein said circulating means comprises a manifold within said housing, a pump for delivering solvent from the solvent supply to said manifold, and wherein said tube is connected to said manifold.

6. A cleaning apparatus as in claim 5, further comprising a second tube and one or more solvent spray nozzles, all within said housing and connected to said manifold.

7. A cleaning apparatus as in claim 1, for use with primary and secondary solvent supplies, wherein said circulating means comprises a manifold within said housing, a solvent pump, a first solvent line connecting the primary solvent supply to an inlet of said pump, a second solvent line connecting the secondary solvent supply to said inlet of said pump, a valve in said first solvent line, a second valve in said second solvent line, and a third solvent line connecting an outlet of said pump to said manifold; and further comprising a drain line from said housing to the primary solvent supply;

a second tube within said housing, both said tubes connected to said manifold;

a second adapter detachably connected to said second tube; and one or more solvent spray nozzles connected to said manifold.

8. A cleaning apparatus as in claim 1, wherein said sprayer has a body or a handle, further comprising a unitary, resilient, wire clip, said clip having at one end a C-shaped portion, a front end of said C-shaped portion adapted to engage the trigger of the sprayer and the back end of said C-shaped portion adapted to engage the sprayer body or handle, said C-shaped portion for holding the sprayer trigger in a retracted position; and the other end of said wire clip having a hook-shaped portion for hanging said wire clip and the sprayer held therewith.

9. A cleaning apparatus as in claim 1, said rack further comprising a movable cross bar from which a sprayer may be hung.

10. A cleaning apparatus as in claim 1, wherein said housing comprises an upper and a lower semi spherical members hinged together.

11. A cleaning apparatus as in claim 10, further comprising a solvent supply interrupt means connected to said housing for interrupting the circulation of solvent upon separation of said housing members.

12. A cleaning apparatus as in claim 1, further comprising a drain from said housing, said drain connected to the solvent supply, whereby solvent in said housing may drain by gravity into the solvent supply.

13. A cleaning apparatus as in claim 1, wherein said housing comprises two housing members having respective mating ends at which said members are coupled together, one of said housing members having a seating edge at its mating end and an outwardly projecting bead adjacent to said seating edge; the other said housing member having an inner rim at its mating end and a inwardly projecting shoulder adjacent said inner rim; said projecting bead engaging said inner rim; and said seating edge seating on said shoulder.

14. An apparatus for cleaning a paint spray gun, the paint spray gun having a material inlet, a trigger, and a body or handle, with solvent from a solvent supply, comprising:

a housing;

a rack within said housing for supporting the paint spray gun;

a unitary, resilient, wire clip, said clip having at one end a C-shaped portion, a front end of said C-shaped portion adapted to engage the trigger of the spray gun and the back end of said C-shaped portion adapted to engage the spray gun body or handle, said C-shaped portion for holding the trigger in a retracted position; and the other end of said wire clip having a hook-shaped portion;

an adapter having a first and a second end, the first end adapted to connect to the material inlet of the sprayer;

a flexible tube within said housing, said tube having one end connected to the second end of said adapter; and means for circulating solvent connected to said tube, for circulating solvent from the solvent supply, through said tube and said adapter, and into the paint spray gun.

15. An apparatus for cleaning a sprayer with solvent from a solvent supply, the sprayer having a material inlet, comprising:

a housing;

a manifold within said housing;

means for circulating solvent connected to said manifold from the solvent supply;

an adapter having a first and a second end, the first end adapted to be removably and positively connected to the material inlet of the sprayer and the second end removably and positively connected to said manifold, said adapter being removable from said housing; and a quick connect/disconnect coupling between said adapter and said manifold.

16. A cleaning apparatus as in claim 15, further comprising a rack within said housing for supporting the sprayer.

17. A cleaning apparatus as in claim 15, further comprising a flexible tube, one end connected to said manifold and the other end connected to said adapter.

18. A method for cleaning a sprayer of accumulated spray material, the sprayer having a material inlet, a trigger, and a handle or body, comprising the steps of:

providing a primary solvent supply;

providing a secondary solvent supply;

providing a housing, a flexible tube within the housing, and a solvent circulating system connected to the tube and selectively connected to the primary and secondary solvent supplies;

connecting an adapter to a material inlet to the sprayer outside of the housing;

connecting the adapter to the tube within the housing;

retracting and retaining the trigger of the sprayer;

hanging the sprayer within the housing;

closing the housing;

circulating solvent from the primary solvent supply, through the tube, adapter, sprayer and back into the primary solvent supply; and circulating solvent from the secondary solvent supply, through the tube, adapter, sprayer and into the primary solvent supply.

19. The method of claim 18, further comprising the steps of:

opening the housing;

uncoupling the adapter from the tube;

removing the sprayer from the housing; and removing the adapter from the sprayer outside of the housing.

20. An apparatus for cleaning a sprayer with solvent from a solvent supply, the sprayer having a material inlet, comprising:

a housing;

a flexible tube within said housing, said tube connected to said solvent supply, said tube having a free end;

an adapter having a first and a second end, the first end adapted to removably connect to the material inlet of the sprayer, the second end removably connected to the free end of said tube, said adapter being removable from said housing; and means for circulating solvent from the solvent supply, through said tube and said adapter, and into the sprayer.

* * * * *